United States Patent [19]

LaPora

[11] Patent Number: 4,933,116

[45] Date of Patent: Jun. 12, 1990

[54] POWER VALVE SHIELD

[76] Inventor: Terry L. LaPora, 2095 Meadowbrook La., Redmond, Oreg. 97756

[21] Appl. No.: 300,371

[22] Filed: Jan. 23, 1989

[51] Int. Cl.[5] ..... F02M 7/20

[52] U.S. Cl. ..... 261/69.1; 261/DIG. 6

[58] Field of Search ..... 261/DIG. 6, 69.1

[56] References Cited

U.S. PATENT DOCUMENTS

| | | | |
|---|---|---|---|
| 1,155,457 | 10/1915 | Witterhahn | 261/DIG. 6 |
| 1,292,613 | 1/1919 | Kessler | 261/DIG. 6 |
| 3,284,063 | 11/1966 | Bickhaus et al. | 261/69.1 |
| 3,337,197 | 8/1967 | Iannelli | 261/69.1 |
| 3,365,179 | 1/1968 | LaForce | 261/69.1 |
| 3,789,702 | 2/1974 | Price | 261/69.1 |
| 4,224,908 | 9/1980 | Bier et al. | 261/69.1 |
| 4,225,536 | 9/1980 | Dougherty et al. | 261/69.1 |

FOREIGN PATENT DOCUMENTS

| | | | |
|---|---|---|---|
| 26427 | of 1909 | United Kingdom | 261/62 |

*Primary Examiner*—Tim Miles

[57] ABSTRACT

A device for preventing damage to the carburetor power valve during engine backfire conditions. The device, which comprises an internal one-way valve and is threaded at one end, is used to replace a throttle body mounting screw on the bottom of the carburetor. Used in conjunction with the device is a means to block the original vacuum port to the power valve and redirect the vacuum through the device.

1 Claim, 1 Drawing Sheet

POWER VALVE SHIELD

BACKGROUND OF THE INVENTION

1. Field of the Invention

The invention relates generally to a device for instantaneously preventing the extreme intake manifold pressure created during a backfire situation from entering the power valve vacuum chamber. This extreme pressure can severely damage the carburetor power valve, causing an internal fuel leak in the carburetor.

2. Description of the Frior Art

Certain carburetors currently in use, especially the Holley two and four barrel models, utilize an unobstructed passage between the intake manifold and the carburetor power valve to supply manifold vacuum to operate the power valve. Carburetors using this direct vacuum source and a diaphragm operated power valve suffer irreversible damage to the power valve diaphragm during manifold backfire situations. Until now, these carburetors have had no protection against power valve blow-out. The Power Valve Shield eliminates this problem.

SUMMARY OF THE INVENTION

The invention relates to a device that is a one-way valve, which is also a mounting screw for attaching the carburetor throttle bodY to the main bodY. The invention also relates to a means to block the original vacuum passage through the throttle bodY and main bodY. It comprises a threaded support member containing a one-waY valve and a means to block the existing direct vacuum passage.

It is an object of the invention to provide an inexpensive device to eliminate the original vacuum route and redirect the vacuum through the one-waY valve in order to prevent damage to the power valve during backfire conditions.

DESCRIPTION OF THE PREFERRED EMBODIMENT

Figure 1:
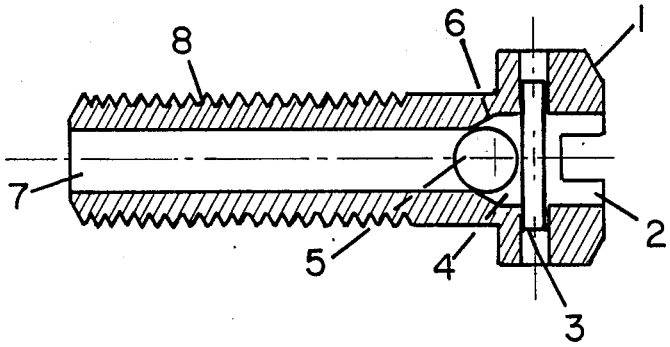
FIG. 1 is a plan view showing an embodiment of the Power Valve Shield.
Figure 2:
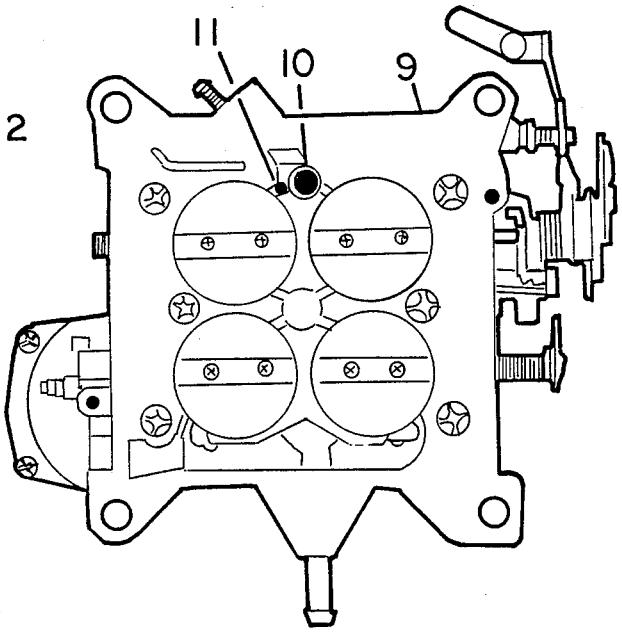
FIG. 2 is a bottom view of a carburetor throttle body showing the mounting position used for the device and the original vacuum passage to be blocked.
Figure 3:
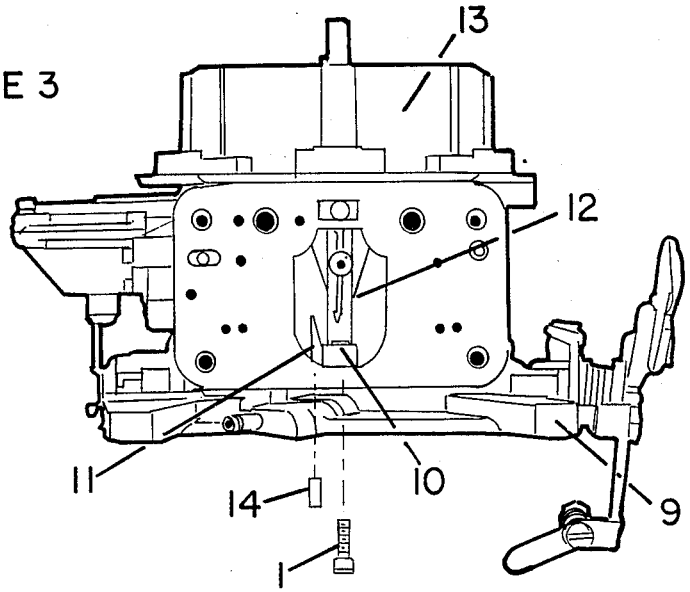
FIG. 3 is an end view of the carburetor main bodY and throttle body with the fuel bowl and metering block removed to show the power valve vacuum chamber which contains the attaching screw hole used by the device and the vacuum passage to be blocked

Referring to FIGS. 1, 2, and 3, an embodiment of the invention is shown in which the Power Valve Shield is used to replace a throttle body mounting screw. In conjunction, a means of blocking the original vacuum passage is used to redirect the vacuum source through the Power Valve Shield.

The support member 1 includes a female hex drive opening 2 at the large end, a valve cavity 4 below the hex drive opening, a one-way valve 5, a valve seat 6, and a valve retainer pin 3 located above the one-way valve. The shank of the support member contains a vacuum passage 7 and a threaded portion 8 to attach the throttle body 9 to the main body 13 of the carburetor. The support member is installed in place of the throttle body attaching screw 1 which creates a new vacuum passage with an integral one-way valve, into the power valve vacuum chamber 12. To allow the Power Valve Shield complete control over excessive manifold pressure, the existing direct vacuum passage 11 must be blocked by means of a plug 14.

Although one detailed embodiment of the invention is illustrated in the draWings and previously described in detail, this invention contemplates any configuration and design of components which will accomplish the equivalent result. As an example, the one-way valve 5 can be a needle valve rather than a ball valve. As a further example, the means of tightening the support member 2 can be an external hex drive, a flat blade screwdriver drive, or a phillips screwdriver drive. As another example, the existing vacuum source opening 11 can be blocked with a press fit obstruction, a threaded plug, or a throttle body to main body gasket which has no provision for the vacuum passage. As yet a further example, the invention can be manufactured as an integral part of the carburetor.

The original vacuum passage 11 is blocked by the insertion of either a press fit or a threaded plug 14. This routes the vacuum source through the threaded member 1 which is inserted into opening 10 to replace the original throttle body attaching screw. In this inverted position backfire pressure drives the ball valve 5 upward into seat 6, sealing the passage and protecting the power valve from damage. During non-backfire or vacuum conditions passage 7 is open to communicate vacuum around ball valve 5 which rests on pin 3.

I claim:

1. A carburetor throttle body mounting screw which is hollow, contains a one way valve and is sized and adapted to replace an existing throttle body attaching screw in a passage leading into the power valve chamber.

* * * * *